United States Patent [19]

Hickman

[11] Patent Number: 4,662,129

[45] Date of Patent: May 5, 1987

[54] ROOF EDGE CONSTRUCTION WITH COMPRESSION AND FLASHING MEMBERS

[75] Inventor: John B. Hickman, Asheville, N.C.

[73] Assignee: W. P. Hickman Company, Asheville, N.C.

[21] Appl. No.: 830,463

[22] Filed: Feb. 18, 1986

[51] Int. Cl.[4] ..... E04B 7/00

[52] U.S. Cl. ..... 52/96; 52/60

[58] Field of Search ..... 52/96, 94, 60, 97

[56] References Cited

U.S. PATENT DOCUMENTS

| | | | |
|---|---|---|---|
| Re. 26,056 | 7/1966 | Hickman . | |
| 1,337,840 | 4/1920 | Hawley . | |
| 1,740,753 | 12/1929 | Vallas . | |
| 1,782,246 | 11/1930 | Schneider . | |
| 2,219,992 | 10/1940 | Hanson . | |
| 2,250,548 | 7/1941 | Ness . | |
| 2,857,861 | 10/1958 | Trostle . | |
| 3,012,376 | 12/1961 | Reddy et al. . | |
| 3,024,573 | 3/1962 | McKinley . | |
| 3,090,161 | 5/1963 | Edwards . | |
| 3,237,352 | 3/1966 | Edwards . | |
| 3,405,485 | 10/1968 | Edwards . | |
| 3,447,273 | 6/1969 | Thom . | |
| 3,488,902 | 1/1970 | Gobel . | |
| 3,503,162 | 3/1970 | Ward . | |
| 3,533,201 | 10/1970 | Tyler . | |
| 3,571,992 | 3/1971 | Comiskey . | |
| 3,608,255 | 9/1971 | Chomes . | |
| 3,624,973 | 12/1971 | Attaway . | |
| 3,719,010 | 3/1973 | Hickman . | |
| 3,731,439 | 5/1973 | Hickman . | |
| 3,735,540 | 5/1973 | Thaler | 52/96 X |
| 3,802,140 | 4/1974 | Hickman . | |
| 4,037,372 | 7/1977 | Patry . | |
| 4,071,987 | 2/1978 | Hickman . | |
| 4,241,549 | 12/1980 | Hall et al. . | |
| 4,419,850 | 12/1983 | Butzen | 52/60 |
| 4,472,913 | 9/1984 | Hickman . | |
| 4,488,384 | 12/1984 | Hickman . | |
| 4,549,376 | 10/1985 | Hickman . | |
| 4,586,301 | 5/1986 | Hickman . | |

FOREIGN PATENT DOCUMENTS

| | | | |
|---|---|---|---|
| 603078 | 8/1960 | Canada . | |
| 1509147 | 11/1969 | Fed. Rep. of Germany . | |
| 1933004 | 1/1971 | Fed. Rep. of Germany . | |
| 2060292 | 6/1972 | Fed. Rep. of Germany . | |
| 2316266 | 10/1974 | Fed. Rep. of Germany . | |
| 2335223 | 1/1975 | Fed. Rep. of Germany . | |
| 1024071 | 3/1966 | United Kingdom . | |
| 1104027 | 2/1968 | United Kingdom . | |
| 1347974 | 2/1974 | United Kingdom . | |
| 2084628 | 4/1982 | United Kingdom | 52/96 |

OTHER PUBLICATIONS

"Drip-Proof Fascia and Cant Dam Systems F-Series", M.M. Systems Corp., 1 p.

Type JJ-Alcoa.

Master-Edge Extruded Aluminum Fascia: The Ultimate in Perimeter Roof Construction (1 p.).

Pomar Building Products, Inc. introduces Hilite Fascia (1 p.).

Technique+Detail 1004NA—Purpose-made accessories for Brass Flat Roofs BRAAS (10 pp.).

BRAAS—PVC flat-roof system (10 pp.).

Hickman Aluminum Construction Products—Our Complete Product Line Includes . . . (16 pp.).

Video Tape Cassette, "Roofcap", 1986.

*Primary Examiner*—Carl D. Friedman

*Assistant Examiner*—Naoko N. Slack

*Attorney, Agent, or Firm*—Harness, Dickey & Pierce

[57] ABSTRACT

An assembly is disclosed for forming a raised roof edge on a building structure that preferably has a generally horizontal roof and a generally vertical outer face. The assembly includes a dam member for forming a water dam or gravel stop, a fascia member, and either a one-piece clamping and flashing member, or separate clamping and flashing members, for biasing and securing the fascia member into a relatively tight and rattle-free interlocking installation on the dam member. Preferably, a roofing material is gripped and held against the dam member as a result of the biasing forces of the clamping member or one-piece clamping and flashing member. The roof edge assembly thereby provides an improved water dam or gravel stop structure that securely retains the roofing material on the roof of the building structure. Also, because the roof edge assembly is adapted for installation on roof structures employing roofing pavers or other roof-covering devices, and is preferably anchored thereby, the roof edge assembly of the present invention features increased stability and resistance to uplift forces in comparison to more conventional roof edge assemblies.

36 Claims, 5 Drawing Figures

FIG. 1.
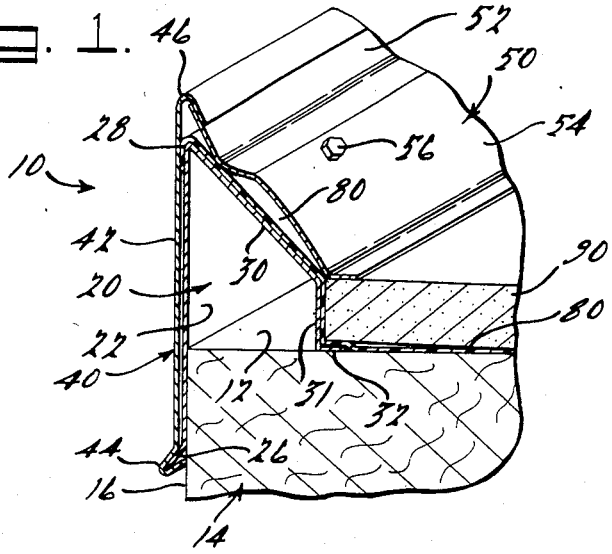
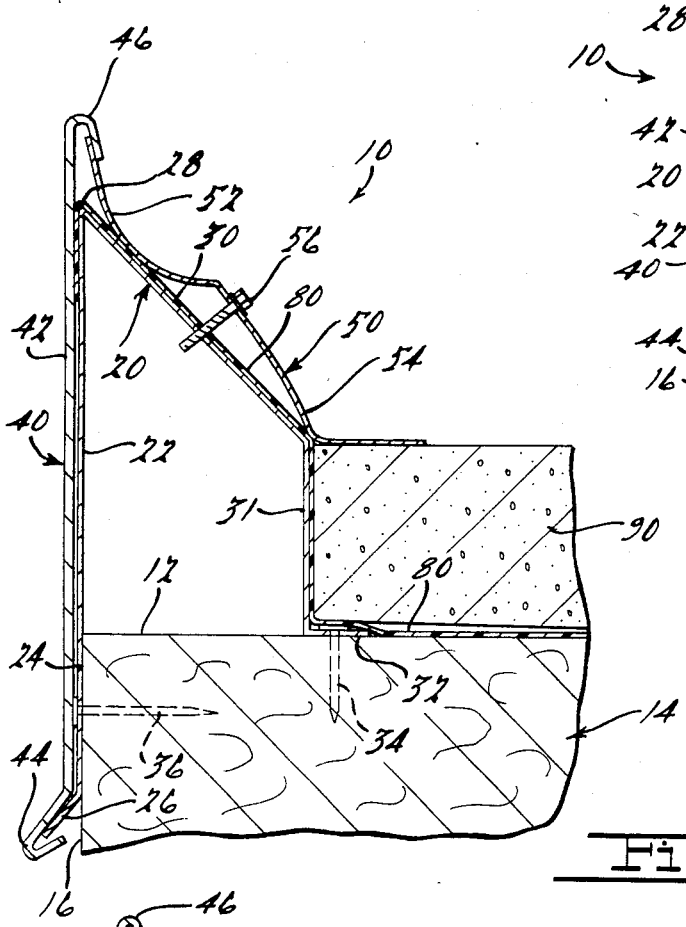
FIG. 2.
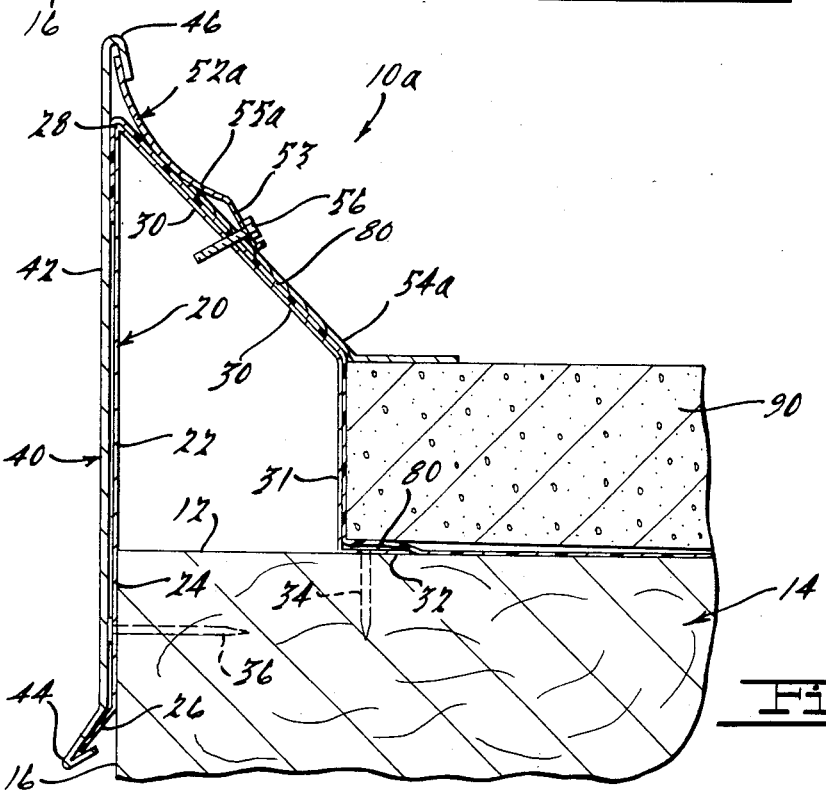
FIG. 3.

ROOF EDGE CONSTRUCTION WITH COMPRESSION AND FLASHING MEMBERS

BACKGROUND AND SUMMARY OF THE INVENTION

The invention relates generally to building structures and more particularly to raised roof edge constructions for such building structures.

Various raised rood edge assemblies, gravel stop assemblies, water dams, and the like, have been provided for purposes of anchoring sheet-like roofing membranes, retaining gravel ballast or other roofing materials controlling water drainage, and for supporting fascia members at the edge of the roof of a building structure. Examples of such previously-provided assemblies are disclosed in U.S. Pat. Nos. 3,719,010; Re. 26,056; 4,071,987, 4,472,913, and 4,488,384, the references cited therein, and in two copending U.S. applications owned by the same assignee as the present invention: Ser. No. 309,062, filed Oct. 6, 1981, entitled ROOF EDGE CONSTRUCTION; and Ser. No. 733,641, filed May 13, 1985, and also entitled ROOF EDGE CONSTRUCTION. The disclosures of these patents and these applications are hereby incorporated herein by reference.

The roof edge assemblies disclosed in the above-referenced patents and applications represent great strides over previous roof edge constructions in terms of stability, simplicity, cost-effectiveness, ease of installation, and effectiveness in anchoring roofing membranes. It has been found, however, in many instances that it is desirable to even further increase the anchoring engagement of a roofing material at the edge of a building structure, and to even further increase the resistance of the roof edge assembly to wind or other uplift loads. It has also been found that the use of preformed roof-covering members, frequently referred to as "roofing pavers", has become highly desirable, and thus the use of such roofing pavers has dramatically increased.

Therefore, the present invention seeks to provide such further increased stability, and such increased anchoring and holding power of a roofing material, in a fascia mounting and supporting assembly that forms a raised roof edge or gravel stop at the outer edge of the roof structure and that is applicable in roofing systems employing roofing pavers or other such roof-covering members. The invention further addresses itself to increasing both the simplicity of the components involved in the assembly and the ease of their installation.

According to the present invention, an assembly is provided for forming a raised roof edge on a building structure of the type that typically has a generally vertical outer face and a generally horizontal roof surface with one or more roof-covering members thereon. The assembly according to the present invention includes a dam member, preferably with a vertical dam portion having an inwardly directed face for generally confronting the outer face of the building structure, and that is anchorable to the building structure generally adjacent an edge portion of the roof surface. A fascia member is installable on the dam member and preferably includes a generally concave upper portion for receiving the upper dam portion therein, as well as a lower fascia portion for receiving a lower edge portion of the dam member therein, when the fascia member is installed on the dam member.

A clamping member is provided in the above-described roof edge assembly for clampingly securing the fascia member to the dam member when the fascia member is installed thereon. Preferably the clamping member is connectable with the dam member with a portion of the clamping member engaging the fascia member so as to bias the fascia member generally against the dam member. A flashing member, which can be a separate flashing member or a flashing portion of a one-piece clamping and flashing member, generally overlaps a portion of the dam member and a portion of the roof-covering member so as to be biased against the roof-covering member and against the dam member when installed thereon. Preferably, a sheet-like roofing material is included on the horizontal roof surface, either above or below the roof-covering member or members, with the roofing material being anchored between the clamping member and the dam member. Either of the separate clamping and flashing members or the one-piece clamping and flashing members, can be either relatively resilient and compressible or relatively rigid in their compositions.

In one embodiment of the invention, a portion of the dam member includes a generally vertical intermediate portion that serves as an end stop for the roof-covering member or members. In an alternate embodiment of the invention, however, such intermediate portion slopes generally downwardly and inwardly relative to the building roof structure to engage the edge portions of the roof-covering member or members, which can be either generally squared-off or beveled in configuration.

Additional objects, advantages, and features of the present invention will become apparent from the following description and appended claims, taken in conjunction with the accompanying drawings.

BRIEF DESCRIPTION OF THE DRAWINGS

FIG. 1 is a perspective view of an exemplary raised roof edge assembly secured to the top edge of a building in accordance with the present invention.

FIG. 2 is a cross-sectional view of the roof edge assembly of FIG. 1.

FIG. 3 is a cross-sectional view, similar to that of FIG. 2, but illustrating another embodiment of the roof edge assembly according to the present invention.

DETAILED DESCRIPTION OF THE PREFERRED EMBODIMENTS

Figure 4:
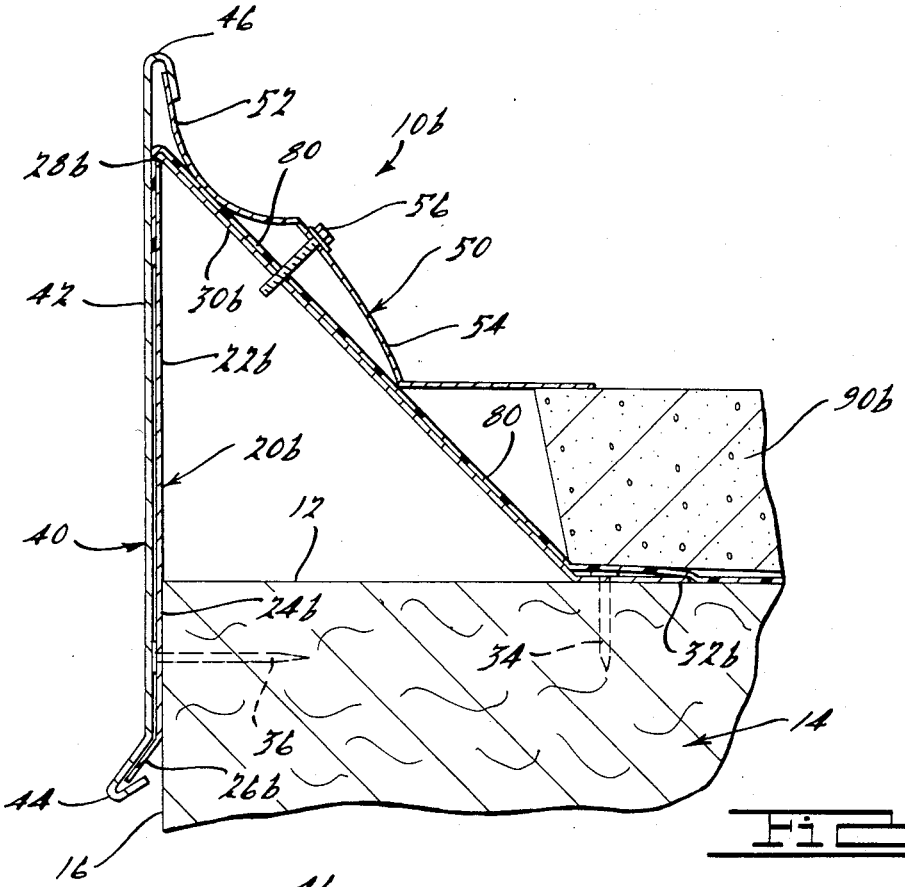
FIG. 4 is a cross-sectional view similar to that of FIG. 2, but illustrating still another embodiment of the roof edge assembly according to the present invention.

FIGS. 1 through 5 illustrate various exemplary embodiments of an assembly for forming a raised roof edge on a building structure in accordance with the present invention. It should be noted, however, that the present invention is applicable in roof edge assemblies for building structures other than that shown for purposes of illustration in the drawings, as well as in other applications for forming building edge constructions.

In FIGS. 1 and 2, a preferred raised roof edge assembly 10 for forming a raised roof edge and water dam on a horizontal roof surface 12 of a building structure 14 generally includes a dam member 20, a fascia member 40, and a clamping and flashing member 50 for securing the fascia member 40 to the dam member 20. Preferably, and perhaps more commonly in practice, the assembly 10 also includes a portion of a preferably flexible and resilient roofing material 80 overlappingly engaging the dam member 20 and being grippingly interposed between clamping and flashing member 50 and the dam member 20. In the application illustrated in the drawings, the building structure 14 includes one or a number of roofing pavers or other roof-covering members 90 on the horizontal roof surface 12. Such roofing pavers are typically in the form of preformed concrete roof paving blocks or panels, or other preformed or precast generally flat roof-covering members, although other forms of roof-covering members can be employed.

The preferred dam member 20 includes a generally vertical dam portion 22 having an inwardly directed face 24 positionable in a generally confronting relationship with an outer face 16 of the building structure 14. The vertical dam portion 22 extends generally upwardly from a lower dam edge portion 26 to an upper dam portion 28 disposed above the roof surface 12 of the building structure 14 when the vertical dam portion 22 is positioned thereon. The dam member 20 preferably also includes a sloping transverse dam portion 30, extending generally downwardly and inwardly from the top of the upper dam portion 28, and a generally vertical intermediate dam portion 31. The intermediate portion 31 serves as an end stop for the roofing pavers 90. A generally horizontal flange portion 32, which is preferably provided at the lower edge of the intermediate dam portion 31, can be secured to building structure by roofing nails or other suitable fasteners 34 for attaching the transverse dam portion 30 to the roof 12. Such fasteners 34 may not be necessary in some applications, however, because of the anchoring effect of the roofing pavers 90 as a result of their overlapping engagement with the flange 32. Fasteners 36 are preferably provided, however, for attaching or anchoring the vertical dam portion 22 to the outer face 16 of the building structure 14. The lower dam edge portion 26 can advantageously be bent or otherwise formed in a generally downwardly and outwardly extending direction (as shown in the drawings).

The preferred fascia member 40 is formed of a sheet material, such as sheet metal, extruded metal, or plastic, for example, and preferably includes a generally vertical fascia portion 42 extending between a lower channel portion 44 and a generally concave upper portion 46. As is illustrated in FIGS. 1 and 2, the concave upper portion 46 receives and overlappingly engages a compression portion 52 of the clamping and flashing member 50, and the lower channel portion 44 interlockingly receives the lower dam edge portion 26. A flashing portion 54 of the one-piece clamping and flashing member 50 overlaps part of the transverse dam portion 30 and the roofing paver 90. A number of fasteners 56 preferably secure the clamping and flashing member 50 to the transverse dam portion 30 in order to bias the fascia member 40 generally against the dam member 20 and to bias the flashing portion 54 generally against both the dam member 20 and the roofing paver 90. Thus the fascia member 40 is securingly and interlockingly retained on the dam member 20, and the roofing paver 90 is urged against the roof surface 12, by the clamping and flashing member 50, which can be formed from a resilient sheet-like spring material, such as aluminum or spring steel, for example. If formed from such a resilient material, the clamping and flashing member 50 is resiliently and compressively deflected by the fasteners 56 in order to resiliently bias the fascia member 40 against the dam member 20 and to resiliently bias the flashing portion 54 against the dam member 20 and the roofing paver 90.

The roofing material 80 is preferably a flexible sheet-like material, which may be a resilient plastic, a resilient rubber or other elastomeric material, a tar paper, a roofing felt, or other suitable roofing materials known to those skilled in the art. The roofing material 80 is preferably flatly retained and anchored on the roof surface 12 by the roofing pavers 90. A portion of the roofing material 80 is interposed and gripped between at least the sloping dam portion 30 and the compression and flashing member 50. The roofing material 80 is shown in FIGS. 1 through 5 as extending over the upper dam portion 28 to be grippingly engaged by the clamping and flashing member 50 and to also overlappingly engage the vertical dam portion 22 and be grippingly engaged between the vertical dam portion 22 and the fascia member 40. Although such an arrangement is preferred, it may be found to be sufficient in some applications if the roofing material extends only far enough to be engaged and grippingly secured between the clamping and flashing member 50 and the dam member 20.

Because the roofing material 80 is grippingly anchored between the clamping and flashing member 50 and the dam member 20, and flatly anchored to the roof surface 12 by the roofing pavers 90, it is very positively and securely retained on the building structure and protected from wind or other forces. By such an arrangement, tears, fatigue failures or punctures tht could cause leaks in the roofing material 80 are substantially avoided, thereby adding to the durability and life of the overall roof structure. Furthermore, because of the above-described anchoring engagement of the roofing pavers 90 with the dam member 20, the stability and resistance to uplift of the entire roof edge assembly 10 is greatly enhanced over that of more conventional roof edge structures.

FIG. 3 illustrates an alternate embodiment of the invention, wherein a raised roof edge assembly **10*a* is generally similar to the raised roof edge assembly 10 shown in FIGS. 1 and 2, with the exception of the provision of alternate two-piece clamping and flashing means in the form of a separate clamping member 52*a* and a separate flashing member 54*a*. Since the remaining components of the alternate raised roof edge assembly 10*a* are substantially similar to the corresponding components of the raised roof edge assembly 10, the same reference numerals are used to indicate such similar corresponding components. It should also be noted that the various optional variations pointed out above in connection with the embodiment of FIGS. 1 and 2** are generally also applicable in the other embodiments of the invention.

The alternate clamping member **52*a* and separate flashing member 54*a* shown in FIG. 3 are similar in function to the one-piece clamping and flashing member 50 shown in FIGS. 1 and 2, except that they are separate members and the preferably resilient clamping member 52*a* engages and preferably resiliently biases the separate flashing member 54*a*, in a generally flat configuration against the transverse dam portion 30 of the dam member 20, as well as against the roofing pavers 90. In order to accomplish such a result, the clamping member 52*a* preferably includes an angulated portion 53 that is curved or angulated in a direction opposite that of a generally arcuate or concave portion 55***a* of the clamping member 52*a*. In virtually all other respects, however, the roof edge assembly 10*a* is generally functionally equivalent and structurally similar to the roof edge assembly 10 of FIGS. 1 and 2.

In FIG. 4, another alternate embodiment of the invention is illustrated, wherein the roof edge assembly 10*b* is generally similar to the roof edge assembly 10 of FIGS. 1 and 2, except for the substitution of a dam member 20*b* that eliminates the generally vertically-extending intermediate dam portion 31 of the dam member 20 in FIGS. 1 and 2. The dam member 20*b* generally includes a vertical dam portion 22*b*, an inwardly directed face 24*b*, a lower dam edge portion 26*b*, an upper dam portion 28*b*, a transverse dam portion 30*b*, and a flange portion 32*b*. It should be noted in this regard that the alternate dam member 20*b* can also optionally be employed with the alternate clamping member 52*a* and separate flashing member 54*a* of FIG. 3.

Also, FIG. 4 illustrates the use of an optical roofing paver 90*b*, which has a beveled edge. It should be noted that either the optical beveled roofing paver 90*b*, shown in FIG. 4, or the generally squared-off roofing paver 90, shown in FIGS. 1 through 3, and 5, can be used in any of the embodiments shown and described herein.

In the alternate construction shown in FIG. 4, the alternate dam member 20*b* does not provide as much of a positive end stop for the roofing pavers 90, but rather it provides a somewhat increased supporting effect for the roofing material 80 between the roofing pavers 90 and the gripping engagement of the clamping and flashing member 50 (or the alternate separate flashing member 54*a*). In other aspects, the roof edge assembly 10*b* is generally functionally equivalent and structurally similar to the embodiments of the invention shown in FIGS. 1 through 3, and therefore the remaining elements are illustrated with the same reference numerals as those used for similar or corresponding elements in the embodiments of FIGS. 1 and 2.

Figure 5:
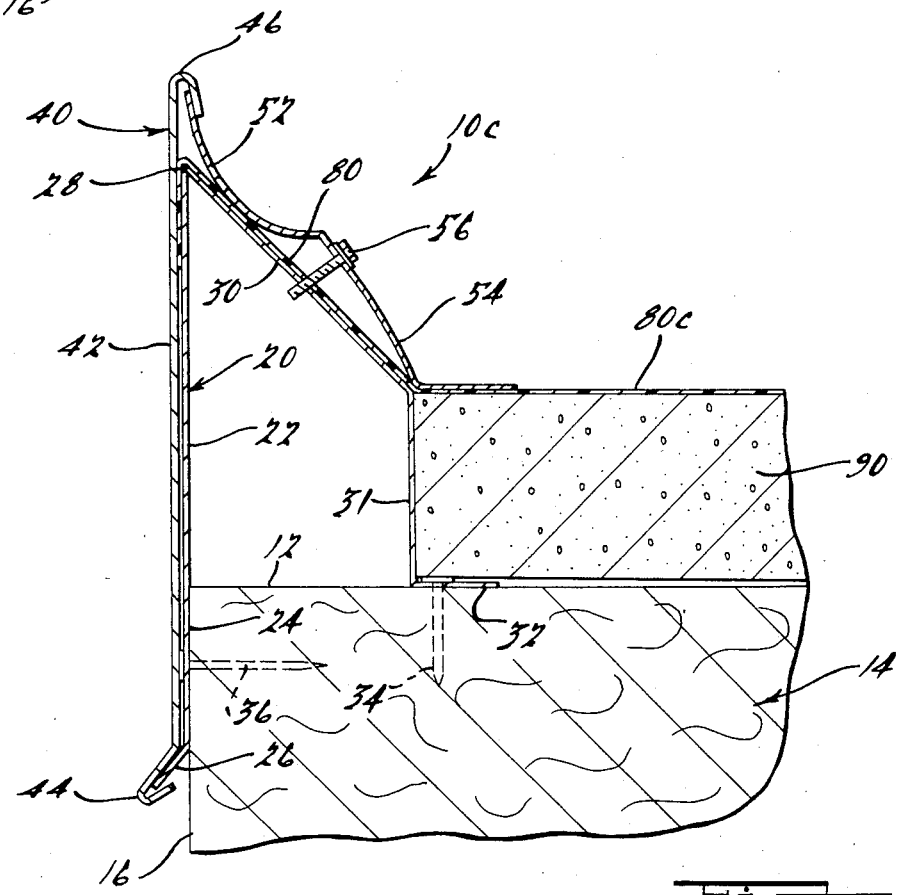
FIG. 5 is a cross-sectional view similar to that of FIG. 2, but illustrating a further embodiment of the roof edge assembly according to the present invention.

FIG. 5 illustrates still another optional construction, wherein a roof edge assembly 10*c* includes a roofing material 80*c* that is disposed above, rather than below, the roofing pavers 90 and thus can be used to substantially prevent the introduction of water or other foreign material between the roofing pavers 90. Although this alternate arrangement does not provide for the above-discussed anchoring of the roofing material 80*c* by the roofing pavers 90, it can optionally be employed with any of the above-discussed embodiments, or variations thereon, if deemed to be advantageous in a particular roof structure application. Similar to the alternate or optional embodiments discussed above, the remaining components are substantially similar to the corresponding elements of FIGS. 1 and 2 and thus are similarly numbered in FIG. 5.

The foregoing discussion discloses and describes exemplary embodiments of the present invention. One skilled in the art will readily recognize from such discussion, and from the accompanying drawings, that various changes, modifications, and variations may be made therein without departing from the spirit and scope of the invention as defined in the following claims.

What is claimed is:

1. An assembly for forming a raised roof edge on a building structure having a generally horizontal roof surface and a plurality of roof paving blocks on the horizontal roof surface, said assembly comprising:

a dam member, and anchoring means for anchoring said dam member to the building structure generally adjacent an edge of the horizontal roof surface;

a fascia member installable on said dam member;

clamping means for clampingly securing said fascia member relative to said dam member, and connecting means for interconnecting said clamping means with said fascia member and said dam member when said fascia member is installed on said dam member, said clamping means urging said fascia member generally against said dam member, said clamping means further biasing the roof paving blocks against the horizontal roofing surface at least in an area generally adjacent the edge of the horizontal roof surface; and flashing means in a generally overlapping relationship with a portion of said dam member and a portion of the roof paving blocks, said clamping means biasing said flashing means against the roof paving blocks and against said dam member when said flashing means is installed on said dam member.

2. An assembly according to claim 1, wherein said clamping means and said flashing means comprise a one-piece resilient clamping and flashing member.

3. An assembly according to claim 1, wherein said clamping means and said flashing means comprises a one-piece relatively rigid clamping and flashing member.

4. An assembly according to claim 1, wherein said clamping means and said flashing means comprise separate resilient members.

5. An assembly according to claim 1, wherein said clamping means and said flashing means comprise separate relatively rigid members.

6. An assembly according to claim 1, wherein said dam member includes a generally vertical dam portion and a transverse dam portion extending in a generally transverse direction relative to said vertical dam portion, said anchoring means including means for anchoring said transverse dam portion to the horizontal roof surface, said connecting means including means for interconnecting said clamping means with said fascia member and said transverse dam portion.

7. An assembly according to claim 6, wherein said clamping means and said flashing means comprise a one-piece clamping and flashing member.

8. An assembly according to claim 6, wherein said clamping means and said flashing means comprise separate members.

9. An assembly according to claim 6, wherein at least a portion of said transverse dam portion slopes transversely in a generally downward and inward direction from said vertical dam portion and includes a generally horizontal flange portion disposed between the horizontal roof surface and at least a portion of the roof paving blocks when said assembly is installed on the building structure.

10. An assembly according to claim 1, wherein the building structure includes a sheet-like roofing material disposed thereon in an overlying relationship with the horizontal roof surface and at least a portion of said dam member, said roofing material being anchored between said clamping means and said dam member when said assembly is installed on the building structure.

11. An assembly according to claim 10, wherein said sheet-like roofing material is in part disposed between the roof paving blocks and the horizontal roof surface.

12. An assembly according to claim 10, wherein said sheet-like roofing material is in part anchored between said fascia member and said dam member.

13. An assembly for forming a raised roof edge on a building structure having a generally vertical outer face, a generally horizontal roof surface, and a plurality of roof paving blocks on the horizontal roof surface, said assembly comprising:

a dam member including a generally vertical dam portion and a transverse dam portion extending in a general transverse direction relative to said vertical dam portion, said vertical dam portion including an upper dam portion and a lower dam edge portion, first anchoring means for anchoring said vertical dam portion generally to the vertical outer face of the building structure with said upper dam portion protruding upwardly above the horizontal roof surface of the building structure, and second anchoring means for anchoring said transverse dam portion to the horizontal roof surface generally adjacent an edge of the horizontal roof surface;

a fascia member installable on said dam member, said fascia member including a generally concave upper fascia portion and a generally concave lower fascia portion, said fascia meber being configured for receiving said lower dam edge portion in said lower fascia portion with said upper fascia portion being disposed generally above said upper dam portion when said fascia member is installed on said dam member;

clamping means for clampingly securing said fascia member to said dam member, and connecting means for interconnecting said clamping means with said fascia member and said dam member, a portion of said clamping means engaging said upper fascia portion and biasing said fascia member generally against said dam member, and said clamping means further biasing the roof paving blocks against the horizontal roof surface at least in an area generally adjacent the edge of the horizontal roof surface; and flashing means in a generally overlying relationship with a portion of said dam member and at least a portion of the roof paving blocks on the horizontal roof surface, said clamping means biasing said flashing means against the roof paving blocks and against said dam member when said flashing means is installed thereon, said clamping means thereby securing said fasica member to said dam member and securing said flashing means relative to the roof paving blocks when said assembly is installed on the building structure.

14. An assembly according to claim 13, wherein said clamping means and said flashing means comprises a one-piece clamping and flashing member.

15. An assembly according to claim 13, wherein said clamping means and said flashing means comprises separate members.

16. An assembly according to claim 13, wherein the building structure includes a sheet-like roofing material disposed thereon in an overlying relationship with the horizontal roof surface and at least a portion of said dam member, said roofing material being anchored between said clamping means and said dam member when said assembly is installed on the building structure.

17. An assembly according to claim 16, wherein said sheet-like roofing material is in part disposed between the roof paving blocks and the horizontal roof surface.

18. An assembly according to claim 16, wherein said sheet-like roofing material is in part anchored between said fascia member and said dam member.

19. An assembly according to claim 13, wherein at least a portion of said transverse dam portion slopes transversely in a generally downward and inward direction from said upper dam portion and includes a generally horizontal flange portion disposed between the horizontal roof surface and at least a portion of the roof paving blocks when said assembly is installed on the building structure.

20. An assembly according to claim 19, wherein the roof paving blocks are clampingly anchored between said generally horizontal transverse portion and said flashing means.

21. An assembly according to claim 20, wherein said clamping means and said flashing means comprise a one-piece clamping and flashing member.

22. An assembly according to claim 20, wherein said clamping means and said flashing means comprise separate members.

23. An assembly according to claim 21, wherein the building structure includes a sheet-like roofing material disposed thereon in an overlying relationship with the horizontal roof surface and at least a portion of said dam member, said roofing material being anchored between said clamping member and said dam member when said assembly is installed on the structure.

24. An assembly according to claim 19, wherein said transverse dam portion also includes a generally vertical intermediate portion between said sloping transverse portion and said generally horizontal flange portion, said intermediate portion serving as an end stop for at least a portion of the roof paving blocks when said assembly is installed on the building structure.

25. An assembly according to claim 13, wherein said clamping means is securable to said transverse dam portion, a portion of said clamping means engaging said fascia member within said generally concave upper fascia portion when said clamping means is secured to said transverse dam portion in order to resiliently secure said fascia member to said dam member.

26. An assembly according to claim 13, wherein said clamping means and said flashing means comprise a one-piece clamping and flashing member securable to said transverse dam portion, said clamping and flashing member having a first clamping portion engaging said fascia member within said generally concave upper fascia portion and a second clamping portion engaging at least a portion of the roof paving blocks when said clamping member is decured to said dam member.

27. An assembly for forming a raised roof edge on a building structure having a generally vertical outer face, a generally horizontal roof surface, and a plurality of roof paving blocks on said horizontal roof surface, said assembly comprising:

a dam member including a generally vertical dam portion and a transverse dam portion, said vertical dam portion including a upper dam portion and a lower dam edge portion, said transverse dam portion sloping in a generally downward and inward direction from said upper dam portion and including a generally horizontal flange portion disposed between the horizontal roof surface and at least a portion of the roof paving blocks when said dam member is installed on said building structure, first anchoring means for anchoring said vertical dam portion to the vertical outer face of the building structure with said upper dam portion protruding upwardly above the horizontal roof surface of the building structure, and second anchoring means for anchoring said horizontal flange portion to the horizontal roof surface generally adjacent an edge of the horizontal roof surface;

a fascia member installable on said dam member, said fascia member including a generally concave upper fascia portion and a generally concave lower fascia portion, said fascia member being configured for receiving said lower dam edge portion in said lower fascia portion with said upper fascia portion being disposed generally above said upper dam portion when said fascia member is installed on said dam member;

a one-piece clamping and flashing member for securing said fascia member to said dam member, and connecting means for interconnecting said clamping and flashing member with said fascia member and said dam member, a portion of said clamping and flashing member engaging said upper fascia portion and biasing said fascia member generally against said dam member, said clamping and flashing member including a flashing portion thereof disposed in a generally overlying relationship with a portion of said sloping transverse portion of said dam member and a portion of the roof-covering member on the horizontal roof surface, said clamping and flashing member clamping at least a portion of the roof paving blocks between said horizontal flange portion and said flashing portion when said assembly is installed on the building structure in order to secure the roof paving blocks to the horizontal roof surface at least in an area generally adjacent the edge of the horizontal roof surface.

28. An assembly according to claim 27, wherein the building structure includes a sheet-like roofing material disposed thereon in an overlying relationship with the horizontal roof surface and at least a portion of said sloping transverse dam portion, said roofing material being anchored between said clamping and flashing member and said sloping transverse dam portion when said assembly is installed on the building structure.

29. An assembly according to claim 28, wherein the roofing material is in part disposed between the roof paving blocks and the horizontal roof surface.

30. An assembly according to claim 27, wherein said transverse dam portion includes a generally vertical intermediate portion between said sloping transverse portion and said generally horizontal flange portion, said intermediate portion serving as an end stop for at least a portion of the roof paving blocks when said assembly is installed on the building structure.

31. An assembly according to claim 27, wherein a portion of said clamping and flashing member engages said fascia member within said generally concave upper fascia portion when said clamping and flashing member is interconnected with said fascia member and said transverse dam portion in order to secure said fascia member to said dam member.

32. An assembly for forming a raised roof edge on a building structure having a generally vertical outer face, a generally horizontal roof surface, and a plurality of roof paving blocks on said horizontal roof surface, said assembly comprising:

a dam member including a generally vertical dam portion and a transverse dam portion, said vertical dam portion including an upper dam portion and a lower dam edge portion, said transverse dam portion sloping in a generally downward and inward direction from said upper dam portion and including a generally horizontal flange portion disposed between the horizontal roof surface and at least a portion of the roof paving blocks when said dam member is installed on said building structure, first anchoring means for anchoring said vertical dam portion to the vertical outer face of the building structure with said upper dam portion protruding upwardly above the horizontal roof surface of the building structure, and second anchoring means for anchoring said horizontal flange portion to the horizontal roof surface generally adjacent an edge of the horizontal roof surface;

a fascia member installable on said dam member, said fascia member including a generally concave upper fascia portion and a generally concave lower fascia portion, said fascia member being configured for receiving said lower dam edge portion in said lower fascia portion with said upper fascia portion being disposed generally above said upper dam portion when said fascia member is installed on said dam member;

a clamping member for securing said fascia member relative to said dam member, and connecting means for interconnecting said clamping member with said fascia member and said dam member, and a portion of said clamping member engaging said upper fascia portion and biasing said fascia member generally against said dam member; and a flashing member installable on said dam member in a generally overlying relationship with a portion of said sloping transverse portion of said dam member and at least a portion of the roof paving blocks on the horizontal roof surface, said clamping member clamping at least a portion of the roof paving blocks between said horizontal flange portion and said flashing member when said assembly is installed on the building structure in order to secure the roof paving blocks to the horizontal roof surface at least in an area generally adjacent the edge of the horizontal roof surface.

33. An assembly according to claim 32, wherein the building structure includes a sheet-like roofing material disposed thereon in an overlying relationship with the horizontal roof surface and at least a portion of said sloping transverse dam portion, said roofing material being anchored between said clamping member and said sloping transverse dam portion when said assembly is installed on the building structure.

34. An assembly according to claim 33, wherein said roofing material is in part disposed between the roof paving blocks and the horizontal roof surface.

35. An assembly according to claim 32, wherein said transverse dam portion includes a generally vertical intermediate portion between said sloping transverse portion and said generally horizontal flange portion, said intermediate portion serving as an end stop for at least a portion of the roof paving blocks when said assembly is installed on the building structure.

36. An assembly according to claim 32, wherein a portion of said clamping member engages said fascia member within said generally concave upper fascia portion when said clamping member is interconnected with said fascia member and said transverse dam portion in order to secure said fascia member to said dam member.

* * * * *

UNITED STATES PATENT AND TRADEMARK OFFICE

CERTIFICATE OF CORRECTION

PATENT NO. : 4,662,129

DATED : May 5, 1987

INVENTOR(S) : John B. Hickman

It is certified that error appears in the above-identified patent and that said Letters Patent is hereby corrected as shown below:

| | | |
|---|---|---|
| Column 1, | line 10, | "rood" should be -- roof --. |
| Column 5, | line 20, | "optical" should be -- optional --. |
| Column 5, | line 22, | "optical" should be -- optional --. |
| Column 5, | line 33, | "aspects" should be -- respects --. |
| Column 8, | line 51, | "decured" should be -- secured --. |

Signed and Sealed this

Tenth Day of November, 1987

*Attest:*

*Attesting Officer*

DONALD J. QUIGG

*Commissioner of Patents and Trademarks*